US008642519B2

(12) United States Patent
Fewkes

(10) Patent No.: US 8,642,519 B2
(45) Date of Patent: Feb. 4, 2014

(54) POWER TRANSMITTING FLUID COMPOSITION

(75) Inventor: Roy Fewkes, Farmington Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 780 days.

(21) Appl. No.: 12/506,013

(22) Filed: Jul. 20, 2009

(65) Prior Publication Data

US 2010/0035778 A1 Feb. 11, 2010

Related U.S. Application Data

(60) Provisional application No. 61/087,108, filed on Aug. 7, 2008.

(51) Int. Cl.
*C10M 141/02* (2006.01)

(52) U.S. Cl.
USPC ..... 508/188; 508/465

(58) Field of Classification Search
USPC ..... 508/131, 463, 473, 591; 208/17–19; 585/1, 10, 12, 326, 329
See application file for complete search history.

(56) References Cited

U.S. PATENT DOCUMENTS

| | | | | |
|---|---|---|---|---|
| 5,750,477 | A | 5/1998 | Sumiejski et al. | |
| 5,891,786 | A * | 4/1999 | Srinivasan et al. | 508/188 |
| 6,627,584 | B2 | 9/2003 | Ozbalik | |
| 6,713,438 | B1 | 3/2004 | Baillargeon et al. | |

FOREIGN PATENT DOCUMENTS

| | | |
|---|---|---|
| DE | 69613012 | 12/2001 |
| EP | 1553158 | 7/2005 |
| WO | WO0058423 A1 | 10/2000 |

* cited by examiner

*Primary Examiner* — Pamela H Weiss

(57) ABSTRACT

The present invention provides a composition for a power transmitting fluid that has improved fuel economy, aeration, and cold temperature performance. Additionally, the composition maintains viscosity at higher temperatures that are in line with the viscometrics of current known automatic transmission fluids. The composition preferably comprises an additive and a base stock having a polyalphaolefin blend.

19 Claims, No Drawings

POWER TRANSMITTING FLUID COMPOSITION

CROSS-REFERENCE TO RELATED APPLICATIONS

This application claims the benefit of U.S. Provisional Application No. 61/087,108, filed on Aug. 7, 2008. The disclosure of the above application is incorporated herein by reference.

FIELD

The present invention relates to a power transmitting fluid composition, and more particularly to a power transmitting fluid composition having polyalphaolefins.

BACKGROUND

The statements in this section merely provide background information related to the present disclosure and may or may not constitute prior art.

When attempting to formulate power transmitting fluids, such as automatic transmission fluids, for fuel economy, the normal approach is simply to lower the viscosity of the fluid in an attempt to reduce viscous drag. However, this approach has a number of potential negative side effects such as reduced fluid film thickness, increased leakage losses, higher oxidation due to the lighter base stocks that have to be used, etc. These potential negative side effects may have an adverse effect on the durability and reliability of the power transmitting fluid over time. Moreover, increased aeration of power transmitting fluids has become an issue in transmissions as transmissions become more compact. Additionally, new transmission architectures and hybrid transmissions preferably use smaller amounts of power transmitting fluids, however, these power transmitting fluids must have improved cold temperature properties in order to properly function.

Accordingly, there is a need in the art for a power transmitting composition that increases potential fuel economy while not reducing the durability of the power transmitting fluid. This composition should also have improved cold temperature performance and reduced fluid aeration properties.

SUMMARY

The present invention provides a composition for a power transmitting fluid that has improved fuel economy, aeration, and cold temperature performance. Additionally, the composition maintains viscosity at higher temperatures that are in line with the viscometrics of current known automatic transmission fluids, such as DEXRON®-VI. The composition preferably comprises an additive and a base stock having a polyalphaolefin blend.

In one embodiment of the present invention, the composition comprises an additive package, a viscosity index improver, and a lubrication grade ester.

In another embodiment of the present invention, the composition comprises two polyalphaolefins having different kinematic viscosities.

The composition uses the unconventional viscosity profiles of the two polyalphaolefins in combination with the low temperature performance of the polyalphaolefins base stock and the lower traction coefficient of the polyalphaolefins to improve fuel economy by between 0.5% to 1.2% while maintaining the durability of the composition. The composition also has improved aeration and cold temperature performance.

Further areas of applicability will become apparent from the description provided herein. It should be understood that the description and specific examples are intended for purposes of illustration only and are not intended to limit the scope of the present disclosure.

DETAILED DESCRIPTION

The following description is merely exemplary in nature and is not intended to limit the present disclosure, application, or uses.

The composition of the present invention is intended for use as a power transmitting fluid. The power transmitting fluid may take many forms without departing from the scope of the present invention. Examples of power transmitting fluids having the composition of the present invention include, but are not limited to, any fluid useful for transmitting power or pressure, such as, for example, automatic or manual transmission fluids, hydraulic fluids, gear oils, and continuously variable transmission fluids. The composition maintains bulk oil viscosity at higher temperatures in line with the viscometrics of current power transmitting fluids, such as DEXRON®-VI, but also lowers the low temperature viscosity in order to gain a fuel economy advantage.

According to an embodiment of the present invention, the composition is comprised of an additive blend and a base stock. The additive blend preferably includes an additive package, a viscosity index improver, and an ester. The base stock includes a polyalphaolefin (PAO) or PAO blend that has an unconventional viscosity profile in combination with good low temperature performance and lower traction coefficient. In one embodiment, the composition of the present invention includes: a) from about 2% to about 20% by weight of the additive package, b) from about 0% to about 8% by weight of the viscosity index improver, c) from about 0% to about 40% by weight of the ester, and from about 8% to about 90% by weight of the PAO blend.

The additive package consists of any number of compounds that are selected to provide a desired property in the fluid. A preferred additive package for use with the present invention includes, but is not limited to, HiTec 3491 by Afton Chemical Corporation (Richmond, Va.). The additive package may be selected from, for example, detergent additives used to clean and neutralize oil impurities, friction modifiers such as molybdenum sulfide used for increasing fuel economy by reducing friction between moving parts, deposit control additives used to prevent the formation of soft sludge and hard deposits of impurities, corrosion or oxidation or rust inhibiting additives used to retard the oxidation of metal, antioxidant additives used to retard the decomposition of the base stock, anti-wear additives or wear inhibiting additives used to protect metal parts, pour point depressants used to improve the fluid's ability to flow at lower temperatures, anti-foam agents used to inhibit the production of air bubbles and foam in the fluid which can cause a loss of lubrication, pitting, and corrosion where entrained air contacts surfaces, seal conditioners used to cause gaskets and seals to swell so that the fluid cannot leak therethrough, metal deactivators used to create a film on metal surfaces to prevent the metal from causing the fluid to be oxidized, extreme pressure agents that bond to metal surfaces in order to keep the surfaces from touching even at high pressure, and dispersants used to cause contaminants to be suspended in the fluid in order to prevent coagulation. It should be appreciated that any combination of additive packages may be employed without departing from the scope of the present invention.

The viscosity index improver (VII) is an additive package that modifies the viscosity of the fluid. The VII preferably consists of polyamethacrylates, such as HiTec 5738 by Afton Chemical Corporation (Richmond, Va.). Additional VII's that may be used in the present invention include, but are not limited to, olefin copolymer VII's, styrene-maleic ester VIIs, and polyisoalkylene components. Moreover, the VII may be completely replaced by an additive package blend as described above. The viscosity index improver may be supplied in the form of a solution in an inert solvent, such as a mineral oil solvent. Chemical derivatives and combinations of these VII's may also be employed in the composition without departing from the scope of the present invention.

The ester preferably consists of one or more lubricant grade esters such as a pure adipate diester base stock containing short chain branched alcohols. The ester is used as a seal swell and also as a solvent for the additive packages. An exemplary pure adipate diester base stock containing short chain branched alcohols is Hatco 2906 by Hatco Corporation (Fords, N.J.). Additionally, pure adipate diester basestocks having medium and/or long branching alcohol chains may also be employed. Various other lubricant grade esters may be employed without departing from the scope of the present invention. Alternatively, the ester may be optionally removed from the composition. Chemical derivatives and combinations of these lubricant grade esters may also be employed in the composition without departing from the scope of the present invention.

A base stock for use in the present composition includes, but is not limited to, a blend of two PAOs each having a different kinematic viscosity. For example, a preferred PAO blend includes a 2 cSt at 100 DEG C. polyalphaolefin (PAO 2 cSt) and a 6 cSt at 100 DEG C. polyalphaolefin (PAO 2 cSt) blend or mixture. Exemplary PAO 2 cSt and PAO 6 cSt include SpectraSyn™ Polyalphaolefins (PAO) 2-10 cSt by ExxonMobil and Synfluid PAO 2 cSt and Synfluid PAO 6 cSt by Chevron Phillips Chemical Company LP (The Woodlands, Tex.). However, any number of PAOs having a number of viscosities may be employed so long as the PAO blend is selected such that the base viscosity of the fluid is greater than or equal to 4.0 cSt at 100 DEG C. For example, the PAO 6 cSt may be replaced with a PAO 5 cSt and the PAO 2 cSt may be replaced with a PAO 4 cSt. When employed in the composition, the PAO 4 cSt is present in an amount from about 20% to about 60% by weight and the PAO 5 cSt may be present in an amount from 0% up to 100% by weight. In another embodiment, only PAO 5 cSt is present in the composition. Examples of additional suitable PAO's include those derived from octene, decene, and mixtures thereof. The PAO blend provides superior low temperature viscosity and exhibits lower traction coefficients in comparison to conventional mineral base stocks thus resulting in a synergistic effect.

Additional additives, fillers, coloring agents, and other components may also be employed in the composition without departing from the scope of the present invention.

In order that the invention may be more readily understood, reference is made to the following example which is intended to illustrate the invention, but not limit the scope thereof:

| Chemical Type | Preferred Composition Range in % by Total Weight | Exemplary Composition in % by Total Weight |
|---|---|---|
| Additive Package[1] | 2-20 | 7.18 |
| Viscosity Index Improver[2] | 0-8 | 3.60 |
| Ester[3] | 0-40 | 11.82 |
| PAO, 2 cSt[4] | 4-25 | 9.40 |
| PAO, 6 cSt[5] | 30-90 | 68.00 |
| TOTAL FORMULATION | | 100.00 |

Exemplary Components by Trade Name:
[1]HiTEC ® 3491
[2]HiTEC ® 5738
[3]DIOA (Hatco 2906)
[4]Synfluid PAO 2 cSt
[5]Synfluid PAO 6 cSt The composition of the present invention successfully maintains kinematic viscosity at both 100 DEG C. and 40 DEG C. in line with the current DEXRON®-VI transmission fluid. However, the Brookfield Viscosity at −40 DEG C. value of approximately 3,900 cP is considerably less than half that of the Brookfield Viscosity at −40 DEG C. of the current DEXRON®-VI fluid. Moreover, when run in the test cycles, the composition of the present invention exhibited a repeatable fuel economy benefit between 0.5% and 1.2%. Moreover, the composition provides significantly better results during aeration testing and cold temperature properties are improved in bench testing, Brookfield viscosity, and Cold Crank Simulations. A summary of the test results for the exemplary preferred composition of the present invention is illustrated below:

| ASTM Testing Procedure | Test | Results |
|---|---|---|
| D445 | Kin. Visc. @ 150° C., cSt | 2.86 |
| D445 | Kin. Visc. @ 100° C., cSt | 6.02 |
| D445 | Kin. Visc. @ 40° C., cSt | 28.03 |
| D2270 | Viscosity Index | 170 |
| D2983 | Brookfield Viscosity @ −40° C., cP | 3980 |
| D5293 | Cold Crank @ −20° C., cP | 522 |
| D5293 | Cold Crank @ −25° C., cP | 809 |
| D5293 | Cold Crank @ −30° C., cP | 1219 |
| D5293 | Cold Crank @ −35° C., cP | 2198 |
| D92 | Firepoint, ° C. | 229 |
| D92 | Flashpoint, ° C. | 209 |
| D4052 | Density | 0.8429 |

The description of the invention is merely exemplary in nature and variations that do not depart from the gist of the invention are intended to be within the scope of the invention. Such variations are not to be regarded as a departure from the spirit and scope of the invention.

I claim the following:

1. A power transmitting fluid composition comprising:

a blend of at least a first polyalphaolefin and a second polyalphaolefin, wherein the first polyalphaolefin has a kinematic viscosity at 100 degrees Celsius of approximately 2 cSt and the second polyalphaolefin has a kinematic viscosity at 100 degrees Celsius of approximately 6 cSt, and an additive package, wherein the composition has a kinematic viscosity at one hundred degrees Celsius of no greater than 6.4 cSt and a Brookfield viscosity at negative forty degrees Celsius of approximately 3900 cP.

2. The power transmitting fluid composition of claim 1 wherein the first polyalphaolefin is present in the composition in an amount from about 4% to about 25% by weight.

3. The power transmitting fluid composition of claim 1 wherein the additive package is present in the composition from about 2% to about 20% by weight.

4. The power transmitting fluid composition of claim 1 further comprising an ester.

5. The power transmitting fluid composition of claim 4 wherein the ester is present in the composition from about 0.5% to about 40% by weight.

6. The power transmitting fluid composition of claim 1 further comprising a viscosity index improver including a polymethacrylate.

7. The power transmitting fluid composition of claim 6 wherein the viscosity index improver is present in the composition from 0.1% to about 8% by weight.

8. The composition of claim 1 wherein the additive package is selected from a group of compositions consisting of detergent additives, friction modifiers, deposit control additives, corrosion or oxidation or rust inhibiting additives, antioxidant additives, anti-wear additives or wear inhibiting additives, pour point depressants, anti-foam agents, seal conditioners, metal deactivators, extreme pressure agents, and dispersants.

9. A composition comprising:

a blend of at least a first polyalphaolefin and a second polyalphaolefin, wherein the first polyalphaolefin has a kinematic viscosity different than the kinematic viscosity of the second polyalphaolefin, and wherein the blend has a kinematic viscosity greater than or equal to approximately 4 cSt at 100 degrees Celsius; and an additive package selected from a group of compositions consisting of detergent additives, friction modifiers, deposit control additives, corrosion or oxidation or rust inhibiting additives, antioxidant additives, anti-wear additives or wear inhibiting additives, pour point depressants, anti-foam agents, seal conditioners, metal deactivators, extreme pressure agents, and dispersants, and wherein the composition has a kinematic viscosity at one hundred degrees Celsius of no greater than 6.4 cSt and a Brookfield viscosity at negative forty degrees Celsius of approximately 3900 cP.

10. The composition of claim 9 wherein a kinematic viscosity of the first polyalphaolefin is less than a kinematic viscosity of the second polyalphaolefin.

11. The composition of claim 9 wherein the first polyalphaolefin has a kinematic viscosity at 100 degrees Celsius of approximately 2 cSt and the second polyalphaolefin has a kinematic viscosity at 100 degrees Celsius of approximately 6 cSt.

12. The composition of claim 9 wherein the first polyalphaolefin is present in the composition in an amount from about 20% to about 60% by weight.

13. The composition of claim 12 wherein the second polyalphaolefin is present in the composition in an amount from about 20% to about 75% by weight.

14. The composition of claim 13 wherein the first polyalphaolefin has a kinematic viscosity at 100 degrees Celsius of approximately 4 cSt and the second polyalphaolefin has a kinematic viscosity at 100 degrees Celsius of approximately 5 cSt.

15. The composition of claim 9 wherein the additive blend is present in the composition from about 2% to about 20% by weight.

16. The composition of claim 9 further comprising an ester.

17. The composition of claim 16 wherein the ester is present in the composition from about 0.5% to about 40% by weight.

18. The composition of claim 9 further comprising a viscosity index improver.

19. The composition of claim 18 wherein the viscosity index improver is present in the composition from about 0.1% to about 8% by weight.

* * * * *